United States Patent [19]

Meadows

[11] 4,333,284

[45] Jun. 8, 1982

[54] EXTRUSION AND BUILDING STRUCTURES

[75] Inventor: David F. Meadows, Milton, W. Va.

[73] Assignee: DoNel Corporation, Mt. Vernon, Ohio

[21] Appl. No.: 157,863

[22] Filed: Jun. 9, 1980

Related U.S. Application Data

[63] Continuation-in-part of Ser. No. 1,593, Jan. 8, 1979, Pat. No. 4,233,790, which is a continuation-in-part of Ser. No. 807,492, Jun. 17, 1977, abandoned.

[51] Int. Cl.[3] ..... E04B 1/00

[52] U.S. Cl. ..... 52/222; 52/202; 160/179; 160/395; 160/368 R

[58] Field of Search ..... 52/222, 202, 203, 63, 52/716; 24/213, 216; 160/395, 179, 368 R

[56] References Cited

U.S. PATENT DOCUMENTS

| | | | |
|---|---|---|---|
| 2,042,726 | 6/1936 | Maeller | 160/394 |
| 3,068,939 | 12/1962 | Commisso | 24/243 |
| 3,143,165 | 8/1964 | Lewis et al. | 160/179 |
| 3,205,547 | 9/1965 | Riekse | 160/392 |
| 3,363,390 | 1/1968 | Crane | 52/716 |
| 3,371,702 | 3/1968 | Keegan | 24/243 |
| 3,392,498 | 7/1968 | Rogers | 52/395 |
| 3,760,860 | 9/1973 | Kelarakis | 160/179 |
| 3,833,046 | 9/1974 | Tombu | 160/395 |
| 3,848,380 | 11/1974 | Assael | 160/395 |
| 4,133,367 | 1/1979 | Abell | 160/392 |
| 4,164,105 | 8/1979 | Herbst | 52/202 |

FOREIGN PATENT DOCUMENTS

| | | | |
|---|---|---|---|
| 1352750 | 1/1964 | France | 24/243 |
| 910194 | 11/1962 | United Kingdom | 52/222 |

*Primary Examiner*—Price C. Faw, Jr.
*Assistant Examiner*—Henry E. Raduazo
*Attorney, Agent, or Firm*—Millard & Cox

[57] ABSTRACT

A two piece extrusion for use in forming storm windows or the like is cut to frame an existing window opening. One extrusion comprises a locking element of which the main portion is formed of a substantially rigid plastic material, which is provided with spaced integral, flexible projections extending angularly outwardly from the stem of the element. The locking element is adapted to be inserted in a channel which comprises the second extrusion. The second extrusion is formed into a rectangular frame so as to hold a flexible translucent, transparent, or opaque sheet locked in the channel by the first extrusion. In assembly the flexible sheet is forced into the channel by the insertion of the locking element. In so doing the flexible sheet is stretched to give a smooth appearance. A second channel is formed by the second extrusion which also extends completely around the frame but is located inwardly of the first channel. The latter channel holds a resilient, generally cylindrical spline which in turn holds in place a screen mounted across the frame and spaced from the plastic sheet.

10 Claims, 5 Drawing Figures

EXTRUSION AND BUILDING STRUCTURES

PRIOR APPLICATIONS

This is a continuation-in-part of copending application Ser. No. 1,593, filed Jan. 8, 1979, now U.S. Pat. No. 4,233,790, which is a continuation-in-part of application Ser. No. 807,492, filed June 17, 1977, now abandoned.

BACKGROUND OF THE INVENTION

The invention disclosed herein relates to buildings and to the construction field. More specifically it relates to the construction and use of assembled frames which are provided with and/or are adapted to receive separate releasable portions of the frame. One obvious use of the invention is in connection with windows for a building. Such windows may be storm windows as well as more premanent installations. Not only is the invention valuable in connection with windows but may be useful in connection with other framed portions of a building such as doors, etc. The invention relates to the complete window construction as well as to its several components. The invention is especially characterized by an extrusion of moldable plastic having a rigid portion and integral flexible locking and sealing projections or flanges.

SUMMARY OF THE INVENTION

The invention relates to the formation of an extruded plastic locking and sealing member for use in the construction industry for sealing and locking a sheet of transparent or translucent or even opaque flexible plastic to a frame in order to form a window or other similar building component. The frame has a channel extending around the periphery thereof into which the several edges of the flexible plastic sheet may be forced by a locking and sealing member. The locking and sealing member is of extruded plastic such a polyvinyl chloride and has a main body, which may be T-shaped in cross section, formed of unplasticized polyvinyl chloride and is herefore rigid. However, it has flexible flanges or projections formed integral with the rigid main body but formed of plasticized polyvinyl chloride so that the flanges may bend to allow the locking and sealing member to move into the channel of the frame and to push the edges of the flexible sheet into the channel ahead of the locking and sealing member and so to lock the sheet in the groove and seal the whole frame.

The plastic frame includes a second channel located inwardly of the first channel. One side of the second channel comprises the innermost side of the first channel. The innermost side of the second channel is shorter than the sides of the first channel. A resilient cylindrical spline is forced into the second channel to hold in place a screen which extends across the frame.

A special feature of my invention is that the flexible film and screen may be removed without substantial damage and stored and thereafter reused if desired.

BRIEF DESCRIPTION OF THE DRAWINGS

Following is a brief description of the drawings.

DESCRIPTION OF THE PREFERRED EMBODIMENT

Figure 1:
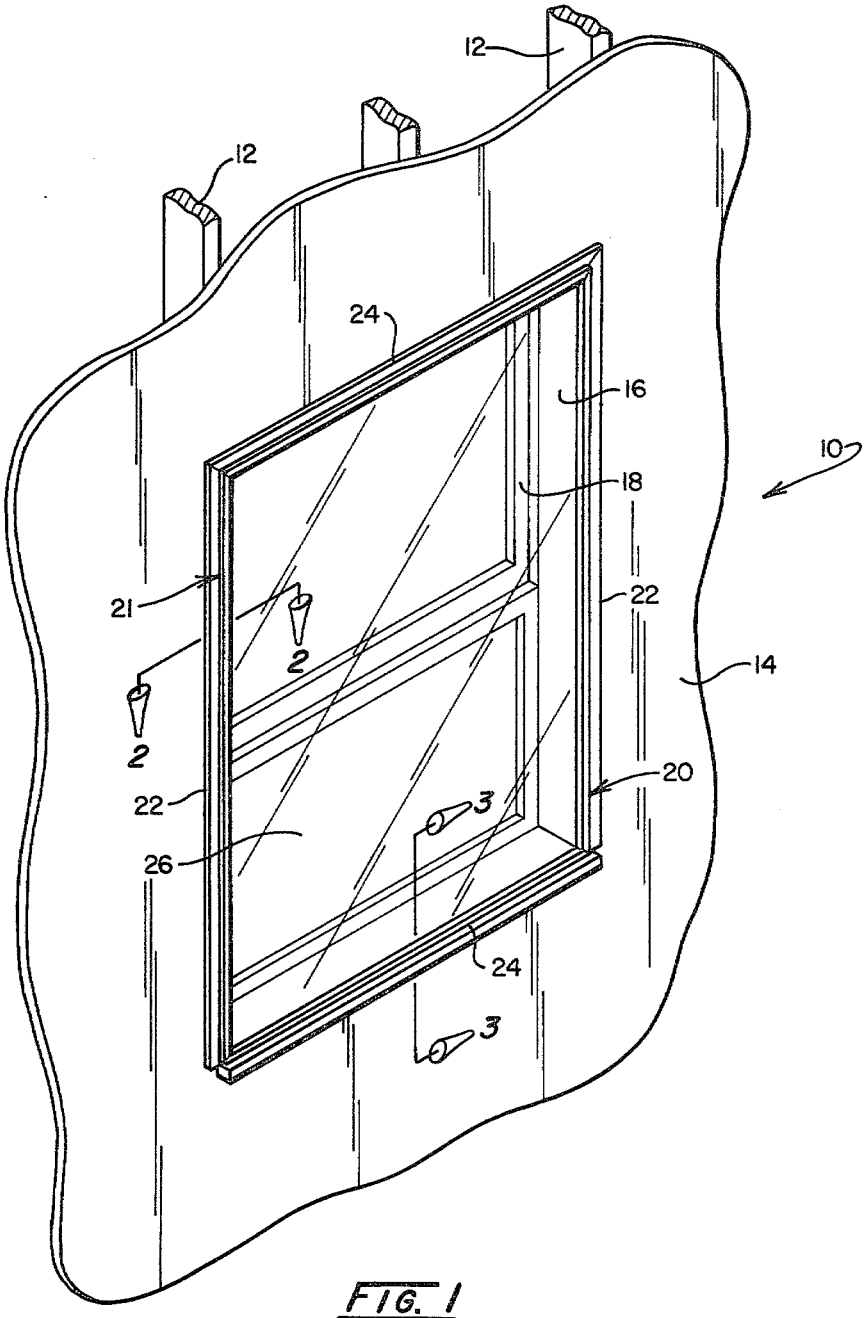
FIG. 1 is a fragmentary view in perspective of a portion of a building having a window and having a storm window constructed according to my invention secured to the frame of said window but spaced from said window to provide an air space.
Figure 2:
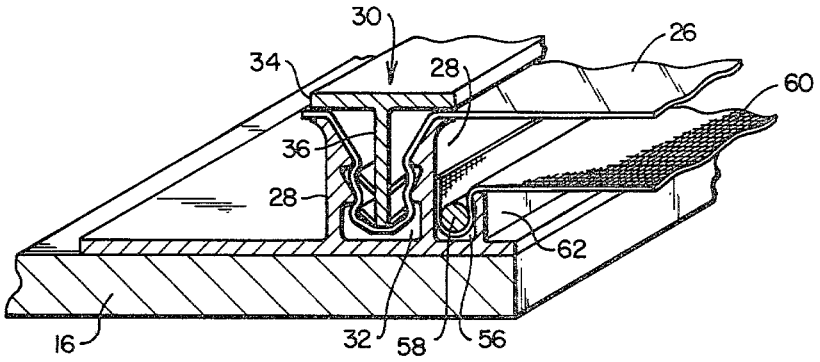
FIG. 2 is a view in cross section taken substantially on the line 2—2 of FIG. 1.
Figure 3:
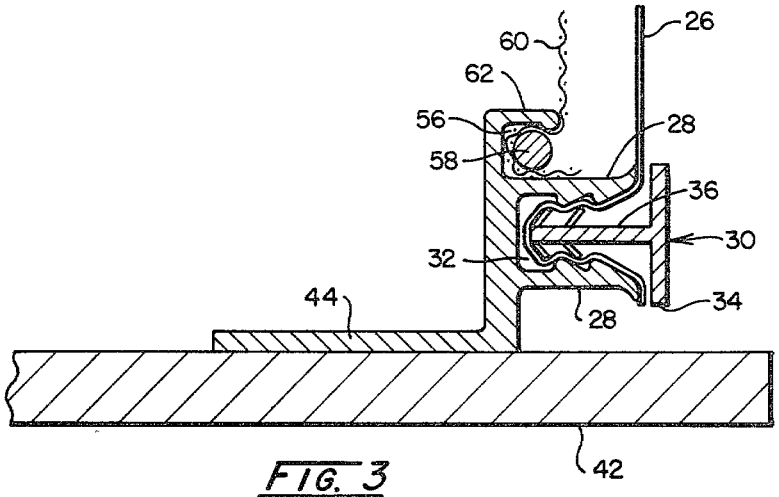
FIG. 3 is a view of cross section taken substantially on the line 3—3 of FIG. 1.

Referring now to FIGS. 1, 2 and 3, the invention is illustrated as installed in a building 10 having uprights 12 to which paneling 14 is secured. In the sidewall there is inserted a structural frame 16 for a window 18. Also secured to the structural frame 16 is a storm window 20 constructed according to my invention. The storm window 20 includes an outer frame 21 formed of sides 22 and ends 24 and a sheet of flexible plastic 26 overlaying the entire frame.

Figure 4:
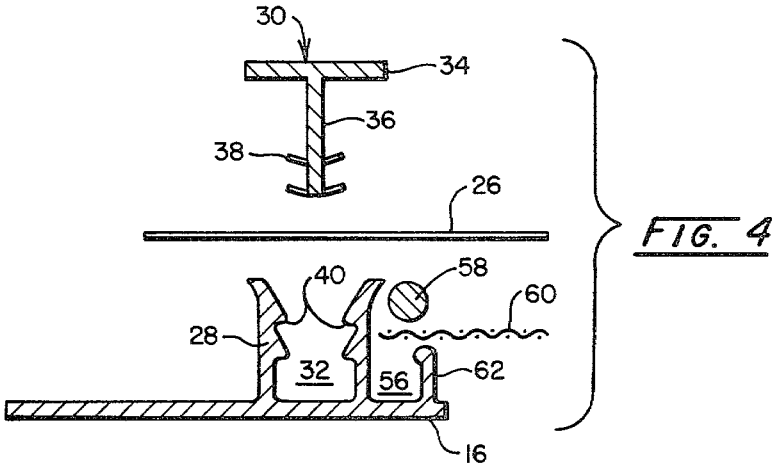
FIG. 4 is a fragmentary exploded view showing in section the components of the outer frame of FIG. 1 prior to assembly of the components into locking and sealing relationship.

As shown in FIGS. 2 and 3, the outer frame 21 is secured to the structural frame 16. The frame 21 may be secured as by nailing or other conventional securing means. The channel members 22, 24 include sides 28 extending around the entire periphery of the frame 21. The flexible sheet 26 which may preferably be translucent or transparent, overlays the entire frame 21 and its edges are forced by locking members such as member 30 into the entire channel 32 formed by sides 28. Although a single locking member may be designed to fit in the entire channel 32 surrounding the entire frame 21, I prefer to provide a separate locking member for each side of the frame. It is possible to use two or more locking member for any side of the frame but I prefer to have only one. The locking member 30 is shown to have a main body which is T-shaped in cross section. The head 34 overlays the mouth of channel 32. The stem 36 of the T is formed mainly of rigid plastic but it is also formed with a plurality of integral flexible projections or flanges 38 extending outward from the stem 36. These flexible projections 38 are, as best seen in FIG. 4, of a thickness less than the stem 36 and are inclined toward the head 34 of the T so as to facilitate the entrance of the locking member 30 into the channel 32 and to resist the withdrawal of the locking member therefrom. Nevertheless, by the exercise of force, the members 30 may be withdrawn to disassemble the window when and if desired.

The channel 32 is formed with teeth 40 (see especially FIG. 4) to further resist the withdrawal of the locking member 30 from channel 32 while allowing the relatively easy insertion of the locking member 30 into the channel. It will be observed that the width of the channel between the crests of teeth 40 is less than the width between the outer ends of projections 38. Thus, the flexible projections 38 will bend as they move past teeth 40 upon insertion and then they will spring back outward as they pass the crests of the teeth, thereby locking the sheet 26 in the channel 32.

Where, as is usually the case, the frame 21 is formed with a sill such as sill 42, shown in FIG. 3, the shape of the channel member is changed. For example it may have the shape of the channel member 44 as shown in FIG. 3. One edge of the flexible transparent sheet 26 is forced into the channel 32 by the locking member 30 in the same manner as described above.

Figure 5:
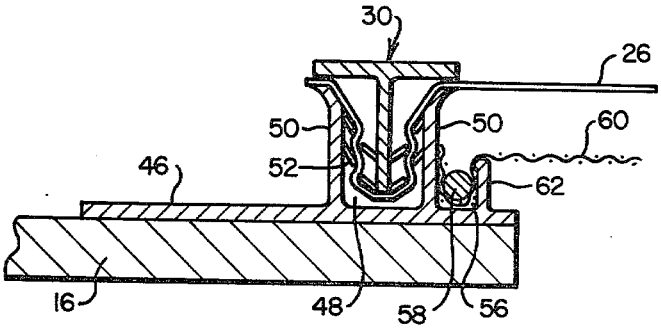
FIG. 5 is a view in section similar to FIG. 2 but showing a modified form of channel.

In FIG. 5 I have shown an alternative form of channel member 46. Channel member 46 has a channel 48 with side members 50 having integral flexible flanges 52. Even these can be dispensed with, if desired, and the interior of the channel 48 may be perfectly smooth. Flexible sheet 26 cooperates with the channel 48 and the locking member 30 as it cooperates with channel member 32 and locking member 30.

Looking now to FIGS. 2–4, it will be observed that a second channel 56 is formed in the extrusion which is located inwardly of the first channel 32. Channel 56 is designed to receive spline 58 which holds stretched screen 60 in place over the frame opening. The spline 58 is of resilient material and well known commercial stock is suitable. The screen 60 is preferably of fiber glass but could be any screening material commercially available. The structure of FIG. 3 to accommodate the lower sill 42 includes the circumferentially extending channel 56 as an inward extension from first channel 32.

It will be observed that either channel 32 of 56 may accommodate either screen 60 or sheet 26. However, it is preferred that sheet 26 be accommodated in channel 32 where it may be removed while leaving the screen 60 in place. It will be observed that the sides 28 of channel 32 are higher than the side 26 of channel 56. This structure serves to space sheet 26 and screen 60 apart to prevent them from beating against each other on windy days or upon opening and closing of doors in a very air-right room.

OPERATION

The frame 21 is formed of a pair of side members 22 and a pair of end members 24. Each of the side members and each of the end members is formed with a pair of channels such as are illustrated in FIGS. 2 and 3. After the frame 21 is secured in place, the screen 60 is held over the frame and locked in place, one side at a time, by its edges being forced into channel 56 by resilient spline 58. Next the flexible member 26 (preferably transparent) is placed over the frame 21 and over the channels 32. Locking members 30 are forced into the channels 32 which forces the edges of the sheet 26 into the channels 32 thus stretching the sheet 26 and providing an effective storm window. When the storm window is not needed, the sheet 26 may be removed by extracting the locking members 30, thus releasing the sheet 26. The frame 21 may be left secured to the structural frame, if desired. The sheet 26 may be stored for reuse. This leaves the screen 60 covering the window opening and allows air to pass freely through the opening.

It is to be understood that the above described embodiments of my invention are for the purpose of illustration only and various changes may be made therein without departing from the scope of the appended claims.

I claim:

1. A window-like structure comprising:

a plurality of rigid side and end members secured together in perpendicular and parallel relationship to form a frame and arranged to be secured to a building structure, the ends of said members being mitered and united together, each of said members of said frame being formed with a first channel which combine to form a continuous channel positioned around the periphery of said frame, said channel including teeth projecting inwardly from its sides;

a sheet of flexible plastic material spreading over all of said side and end members;

a plurality of locking members being inserted in said continuous channel, thereby forcing a portion of said flexible plastic sheet into said channel and stretching, sealing, holding, and locking said sheet to said frame in said channel;

each said locking member being formed as a one piece extrusion having a generally T-shape in cross section with a stem and a head both of which are formed of substantially rigid plastic material and which has both sides of the stem of the T provided with integral spaced angularly and outwardly extending projections of plastic material substantially more flexible than the substantially rigid material of the main section of the T and integrally united with the substantially rigid material of the main section of the T, said projections having a thickness less than the stem and being inclined from the stem toward the head;

the width of the channel between the crests of the teeth being less than the width between the outer ends of the projections, the teeth and projections combining to lock the sheet in place, the improvement comprising:

means forming a second channel in the side and end members, said second channel being spaced inwardly from the first channel and designed to receive a resilient spline, a sheet of screen material extending over the frame and the second channel and being locked in said second channel by the spline.

2. The structure of claim 1 wherein the spline is cylindrical.

3. The structure of claim 2 wherein the screen material allows the free passage of air therethrough.

4. The structure of claim 3 wherein the depth of the second channel is less than the depth of the first channel.

5. The structure of claim 4 wherein the screen and sheet are spaced apart while they are locked in place across the frame.

6. The structure of claim 1 wherein the screen material allows the free passage of air therethrough.

7. The structure of claim 1 wherein the depth of the second channel is less than the depth of the first channel.

8. The structure of claim 7 wherein the screen and sheet are spaced apart while they are locked in place across the frame.

9. The structure of claim 1 wherein the screen and sheet are spaced apart while they are locked in place across the frame.

10. The structure of claim 9 wherein the screen material allows the free passage of air therethrough.

* * * * *